US005247817A

United States Patent [19]

Körner et al.

[11] Patent Number: 5,247,817

[45] Date of Patent: Sep. 28, 1993

[54] MOTOR VEHICLE CLOSURE LOCKING DEVICE

[75] Inventors: Albrecht Körner; Franz Waschitschek, both of Sindelfingen; Klaus Claar, Gechingen; Andreas Schmidt, Stuttgart, all of Fed. Rep. of Germany

[73] Assignee: Mercedes-Benz AG, Fed. Rep. of Germany

[21] Appl. No.: 756,859

[22] Filed: Sep. 11, 1991

[30] Foreign Application Priority Data

Sep. 12, 1990 [DE] Fed. Rep. of Germany ..... 4028897

[51] Int. Cl.[5] ..... E05B 53/00

[52] U.S. Cl. ..... 70/240; 70/256; 70/264; 292/DIG. 14; 292/DIG. 43

[58] Field of Search ..... 70/264, 240, 241, 256, 70/257; 292/DIG. 14, DIG. 43

[56] References Cited

U.S. PATENT DOCUMENTS 4,237,709 12/1980 Krügener et al. ..... 70/240 X
4,805,427 2/1989 Bates et al. ..... 70/264
4,910,980 3/1990 Katoh ..... 70/264 X
4,917,412 4/1990 Swan et al. ..... 70/264 X
4,961,601 10/1990 Lindholm et al. ..... 292/DIG. 72 X

FOREIGN PATENT DOCUMENTS 2362038 11/1978 Fed. Rep. of Germany .
3017049 3/1984 Fed. Rep. of Germany .
2742467 8/1985 Fed. Rep. of Germany .
3150564 9/1985 Fed. Rep. of Germany .
3018733 12/1986 Fed. Rep. of Germany .
3625068 9/1987 Fed. Rep. of Germany .
6365 of 1886 United Kingdom ..... 292/DIG. 56

*Primary Examiner*—Lloyd A. Gall
*Attorney, Agent, or Firm*—Evenson, McKeown, Edwards & Lenahan

[57] ABSTRACT

A locking device for a flap or door of a motor vehicle contains, in addition to the conventional flap or door lock which is unlockable and lockable by a lock cylinder, an additional bolt acting in parallel with the lock on a closing member of the same flap or door. The bolt is prestressed by a spring in the direction of its securing position and is movable mechanically in the direction of its release position by the lock cylinder via a linkage with a free-play connection.

14 Claims, 3 Drawing Sheets

1
2
3
4
5
6
7
8
9
10
11
12
13
14
15
16
17
18
19
20
21
22
23
24
25
26
27
28
29
33
34
A
VG
KL
S
DF1
DF2
SV
AB
G
ZV
II

MOTOR VEHICLE CLOSURE LOCKING DEVICE

BACKGROUND AND SUMMARY OF THE INVENTION

The present invention relates to a locking device for a flap or door of a motor vehicle, and, more particularly, to a locking device having a lock cylinder, an additional bolt and a spring-loaded detent member.

DE 3,018,733 C2 shows a locking device which affords a high degree of security against break-ins. Nevertheless, in the known arrangements, the additional bolt can be actuated solely by the key operation of the lock cylinder, which is coupled mechanically both to the lock and rigidly to the bolt, when the lock cylinder is brought into its mechanically secured position or rotated out of this again by the key.

A spring-loaded detent member complementary with a closing member of the flap or door prevents the lock cylinder from being brought into its mechanically secured position when the flap or door is open. Prelocking preceding the closing of the flap or door and additional securing of the locking device are therefore impossible.

DE 3,018,733 C2 describes a purely mechanical arrangement in which there is also no provision of any adjusting element of a central-locking system for the flap lock or door lock.

A comparable arrangement with an additional bolt, in which there are, on the one hand, a central-locking adjusting element for the lock and, on the other hand, in addition to the neutral key withdrawal position of the lock cylinder allowing only the use of the lock-adjusting element, a mechanically secured position which likewise allows the key to be withdrawn, is supplied as special equipment for the boot lid of vehicles of the Mercedes-Benz 126 type (S-class).

In the mechanically secured position of the lock cylinder, the special equipment and also other known vehicles with central locking do not provide any possibility of unlocking the associated lock via a central-locking system. The disadvantage of this is that there is often the desire to have all the doors to the passenger space unlocked during travel, but at the same time to keep the boot space secured against unauthorized access.

Moreover, the additional bolt comes into operation only in the mechanically secured position. Here too, because of the detent member already mentioned, a prelocking of the lock with additional securing by the bolt is impossible. In contrast, the additional bolt is inoperative in the neutral key withdrawal position of the lock cylinder, in which the central unlocking and locking of the associated lock are also possible.

An object of the present invention is to provide a motor vehicle closure locking device with greater operating convenience, while at the same time ensuring an equally high degree of security.

This object has been achieved by the configuration of the additional bolt prestressed by a spring in the direction of the securing position and movable mechanically into its release position counter to the force of the spring by the lock cylinder via a linkage with a free-play connection.

Instead of the known kinematic coupling of the additional bolt of the lock cylinder, a free-play linkage is now provided between the two. Furthermore, the bolt is prestressed in a way known per se in the securing direction by a spring.

As in the past, the additional bolt can be brought mechanically into its release position by the key actuation of the lock cylinder. In the simplest embodiment, the additional bolt is held in the release position by the detent member counter to the force of its spring immediately upon opening of the flap or door the lock cylinder becoming free of any force because of the free-play connection in the linkage.

It is thereby now possible, without varying the release position of the additional bolt, to rotate the key out of an unlocking position back into a neutral key withdrawal position.

By virtue of the detent member already mentioned, the bolt is retained in the release position counter to the force of the spring prestressing it, even when the lock cylinder has been brought temporarily or permanently into its mechanically secured position, but the associated flap or door has not yet been closed. A prelocking of the locking device preceding the closing of the flap or door thereby also now becomes possible.

In a simple version, the detent member also performs the function of an ejector which pushes the closing member out of the receptacle assigned to it and which at the same time keeps the bolt in the release position.

Similar detent devices for spring-loaded pushbolts are also known elsewhere (DE 2,362,038 B2, DE 3,017,049 C2).

In a vehicle equipped with central locking, the free-play linkage arrangement now makes it possible also to actuate the additional bolt by means of a further adjusting element of the central-locking system independently of the associated lock cylinder, so that even in a "normal" central locking of the vehicle, which can, for example, also be controlled from the lock cylinders of the driver's or front-seat passenger's door (so-called multi-point operation), the additional bolt is now brought into its securing position and, with central unlocking, into its release position again.

The security already attained hitherto can thus be utilized in an extremely convenient way.

If the detent member is appropriately designed, under some circumstances it is possible to do without an additional detent pawl when the adjusting element can hold the spring force acting on the bolt before the flap or door is opened by the actuation of the lock.

However, advantageously, the linkage for actuating the additional bolt is assigned a detent pawl which, in the release position of the bolt spring-loaded in the securing direction, drops in and retains the latter; it can be lifted out again by means of the lock cylinder or the adjusting element, so that the spring prestressing the bolt in the securing direction then brings the linkage into the securing position again, provided that the flap or door is closed.

BRIEF DESCRIPTION OF THE DRAWINGS

These and other objects, features and advantages of the present invention will become more apparent from the following detailed description of a presently preserved embodiment when taken in conjunction with the accompanying drawings.

DETAILED DESCRIPTION OF THE DRAWINGS

It will be noted, in the first place, that the same reference symbols have been used for identical parts in all four drawing figures.

Figure 1:
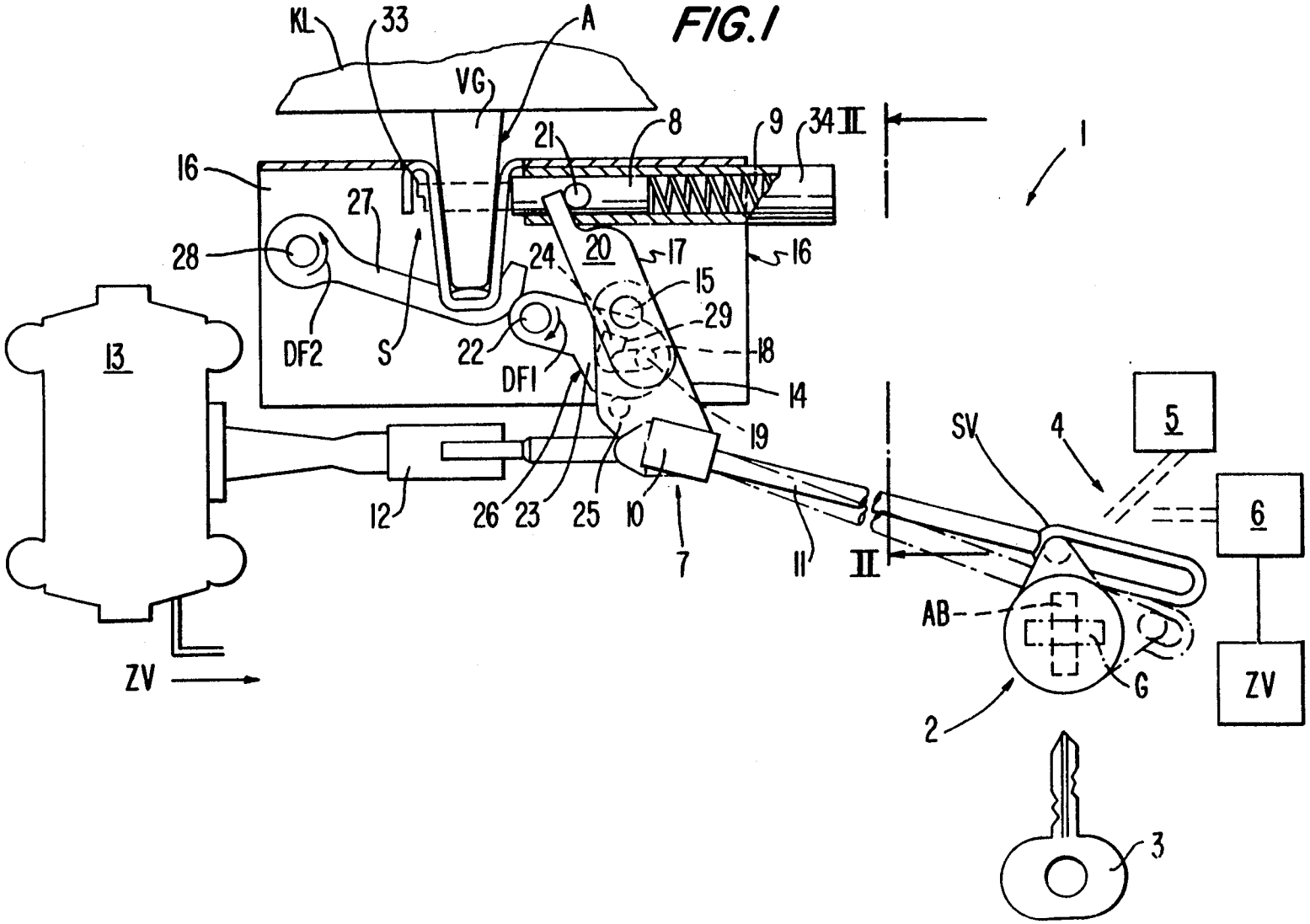
FIG. 1 shows a schematic overall view of the locking device of the present invention in the securing position, or in the mechanically secured position of the lock cylinder.

In a locking device designated generally by the numeral 1 in FIG. 1, a lock cylinder 2 is pivotable to the right or left out of a neutral key withdrawal position AB (the vertical keyhole position represented by broken lines) by way of a key 3. Complementary with the lock cylinder 2 is a lock 5 which can be unlocked and locked via conventional operative connections 4, represented for simplicity by broken lines, both by way of the lock cylinder 2 and by way of an adjusting element 6 of a central-locking system ZV which has a multi-point operation.

The actual lock arrangement itself is not the subject of the present invention described here and is therefore not shown in any more detail. A corresponding lock-/adjusting element assembly is described, for example, in U.S. Pat. No. 4,815,306 which is incorporated by reference herein. Unlocking of the lock makes it possible to open the flap or door by hand, for example by pressing in the lock cylinder or pulling on a door handle, whereas this is prevented when the lock is locked, for example by the uncoupling of the particular lock handle or door handle from a detent pawl or the like of the lock.

The lock cylinder 2 can in a known way be brought by way of the key 3 in the locking direction (here pivoting to the right) into a mechanically secured position G (the horizontal key hole position represented by dot-and-dash lines), in which the key 3 can likewise be withdrawn and the lock 5 cannot be unlocked again by the adjusting element 6. On the contrary, the operative connections 4 are then blocked by tumblers (not shown) of the lock cylinder 2.

The lock cylinder 2 is connected mechanically via a free-play connection SV located, for example, on its rear side to a linkage designated generally by the numeral 7, the individual parts of which are also described below. This linkage 7 is movable independently of the operative connections 4 between the lock cylinder 2 and the lock 5, and the free-play connection SV is provided in addition to a known free-play connection (not shown) of the lock cylinder 2 to the operative connections 4 which is necessary for actuating the lock 5 via the adjusting element 6.

The free-play connection SV is indicated in simplified form in FIG. 1 by an eccentric driving pin on the lock cylinder 2 and an end shackle on a rod 11. Other equivalent solutions can be employed without departing from the scope of the present invention.

Figure 3:
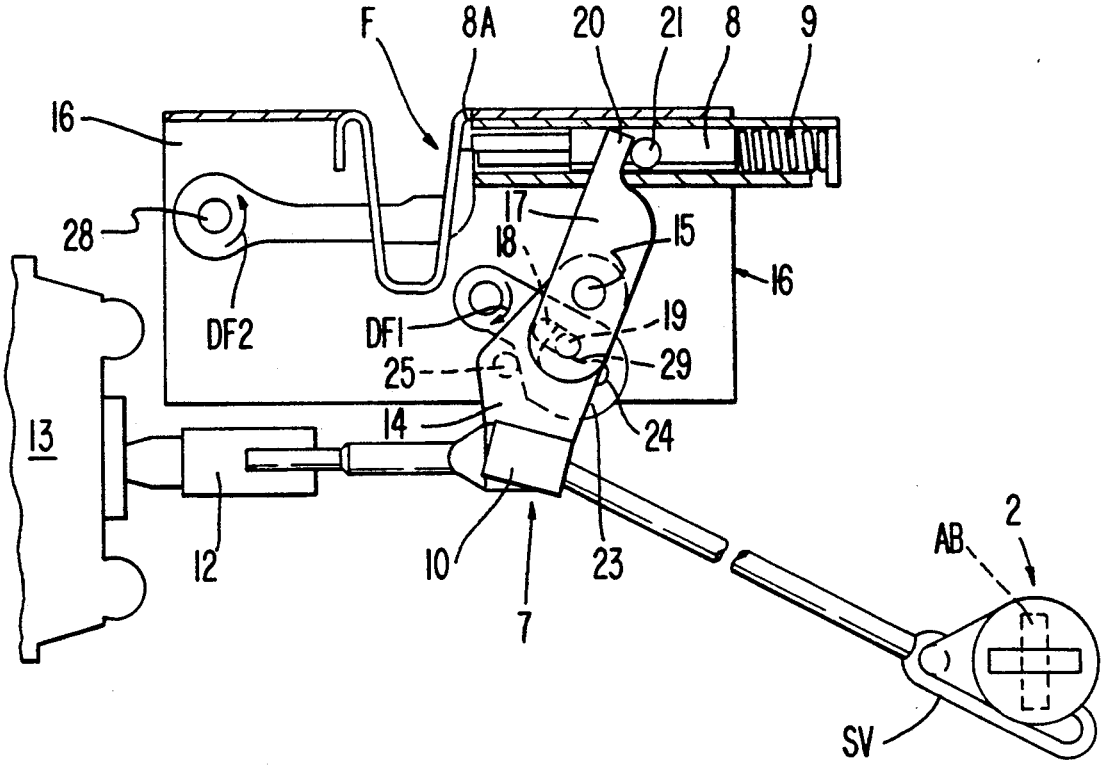
FIG. 3 is a view of the locking device from the same direction as in FIG. 1 in the release position.
Figure 4:
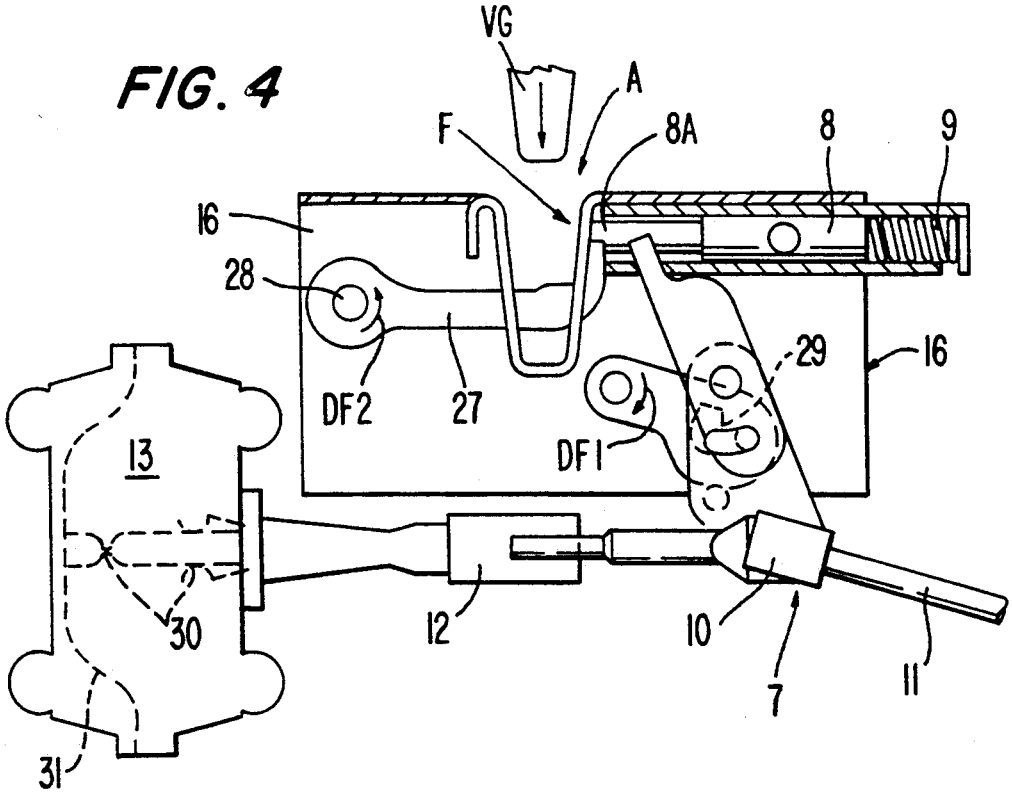
FIG. 4 is a view corresponding to that of FIG. 3, but with the actuating linkage in the locking position with the flap/door open.

The linkage 7 serves for actuating an additional bolt 8 which can be brought, via the linkage 7, out of a securing position S (FIG. 1), into a release position F (FIGS. 3 and 4). In the securing position S, in the direction of which it is prestressed by a spring 9, the additional bolt 8 passes in a conventional manner through a closing member VG which itself is fastened to a flap KL, shown in part in its closed end position (FIG. 1) and assigned to the lock 5, i.e., lockage by the lock 5, with the closing member VG being introduced into a receptacle A. Because the bolt 8 is guided axially in the bores on both sides of the closing member VG or the receptacle A, even when the lock 5 has been overcome this additional locking by positive engagement can be broken open only by extreme force. In addition, a security housing can also be provided around the additional bolt 8 in a known way as shown, for example, in U.S. Pat. No. 4,815,306 which is incorporated by reference herein. Of course, with the lock 5 unlocked, the additional bolt 8 must always also be in its release position F.

The bolt 8 can assume the securing position S both in the mechanically secured position G and in the neutral key withdrawal position AB of the lock cylinder 2. In the former case, the linkage 7 and the operative connections 4 to the lock 5 are blocked by the tumblers of the lock cylinder 2 in a known manner. This is indicated in FIG. 1 by the fact that the free-play connection SV is at dead center in the mechanically secured position G of the lock cylinder 2.

The play allowed by the free-play connection SV must be such an amount that the lock cylinder 2 can be rotated back out of its mechanically secured position G into the neutral key withdrawal position AB, on one hand, and out of an unlocking position into the neutral position AB, on the other hand, without varying the respective locking or securing state of the lock and additional bolt Articulated at a common point of articulation 10 of the linkage 7 are, on the one hand, the rod 11 leading to the free-play connection SV with the lock cylinder 2 and, on the other hand, an adjusting member 12 of a further adjusting element 13 connected to the central-locking system ZV. As already mentioned, the two adjusting elements 6 and 13 act independently of one another on different operative connections 4 and 7, respectively.

When the lock cylinder 2 is in the neutral key withdrawal position AB (vertical), the linkage 7 can now also be moved by the further adjusting element 13 via the central-locking system ZV because of the free-play connection. Since this can be activated from a plurality of closing points (i.e., the driver's door, front-seat passenger's door, tailgate, etc.), operating convenience is thereby increased, because, in order to bring the additional bolt 8 into its securing position, it is merely necessary to lock the vehicle centrally. This is to be contrasted with a known arrangement in which the high security of the additional locking was obtained at the expense of the need to actuate the associated lock cylinder 2 into its mechanically secured position G.

The common point of articulation 10 is located on a first pivoting lever 14 which is pivotable about a first bearing journal 15. A two-armed lever 17 is also pivotable in a plane parallel to the first pivoting lever 14 about the same bearing journal 15 fastened to a carrier plate 16. The lever 17 is coupled to the first pivoting lever 14 via a drive connection with small play defined by a long hole 18 of the first pivoting lever 14 and a pin 19 inserted through the long hole 18 and fastened to an arm of the two-armed lever 17 facing the common articulation point 10. By way of this drive connection 18, 19, therefore, the two-armed lever 17 can be taken up by the first pivoting lever 14 or take this up after a short idle stroke. The two-armed lever 17 engages with its other arm 20 facing away from the common articulation point 10 on a release pin 21 connected firmly to the additional bolt 8.

Furthermore, on the carrier plate 16 there is a second bearing journal 22 which is offset axially relative to the first bearing journal 15 and about which is pivotably arranged a detent pawl 23 prestressed in the clockwise direction by way of a known type of torsion spring DF1 schematically represented by a force arrow in FIG. 1. The detent pawl 23 lays, in relation to the two-armed lever 17, in a parallel plane extending on the other side of the first pivoting lever 14 (FIG. 2).

An angled perforation 24 of the detent pawl 23 is provided with a longer and a shorter leg. In the illustrated position, the longer leg covers the long hole 18 of the first pivoting lever 14. The pin 19 of the two-armed lever 17 also passes through the perforation 24, the overall clear width of which corresponds at least to the pin's diameter so that it is slidably displaceable therein. Furthermore, arranged on the first pivoting lever 14 at a short distance from the long hole 18 is a lift-out pin 25 which mates in sliding contact with an oblique contour 26 of the detent pawl 23 and which together therewith forms a lifting-out device for the detent pawl 23, the functioning of which will be described later in connection with FIG. 3. The force of the torsion spring DF1 of the detent pawl 23 is supported on the lift-out pin 25.

Finally, a detent member 27 in the form of a second pivoting lever is pivotable about a third bearing journal 28 on the carrier plate 16 and is prestressed in the counter-clockwise direction by a known type of torsion spring DF2 which is also represented by a force arrow. The end of the detent member 27 passes through the receptacle A for the closing member VG. In the illustrated securing position of the locking device 1, the detent member 27 is supported on the closing member VG. The functioning of the detent member 27 is evident especially from FIGS. 3 and 4 and is described in conjunction therewith.

Figure 2:
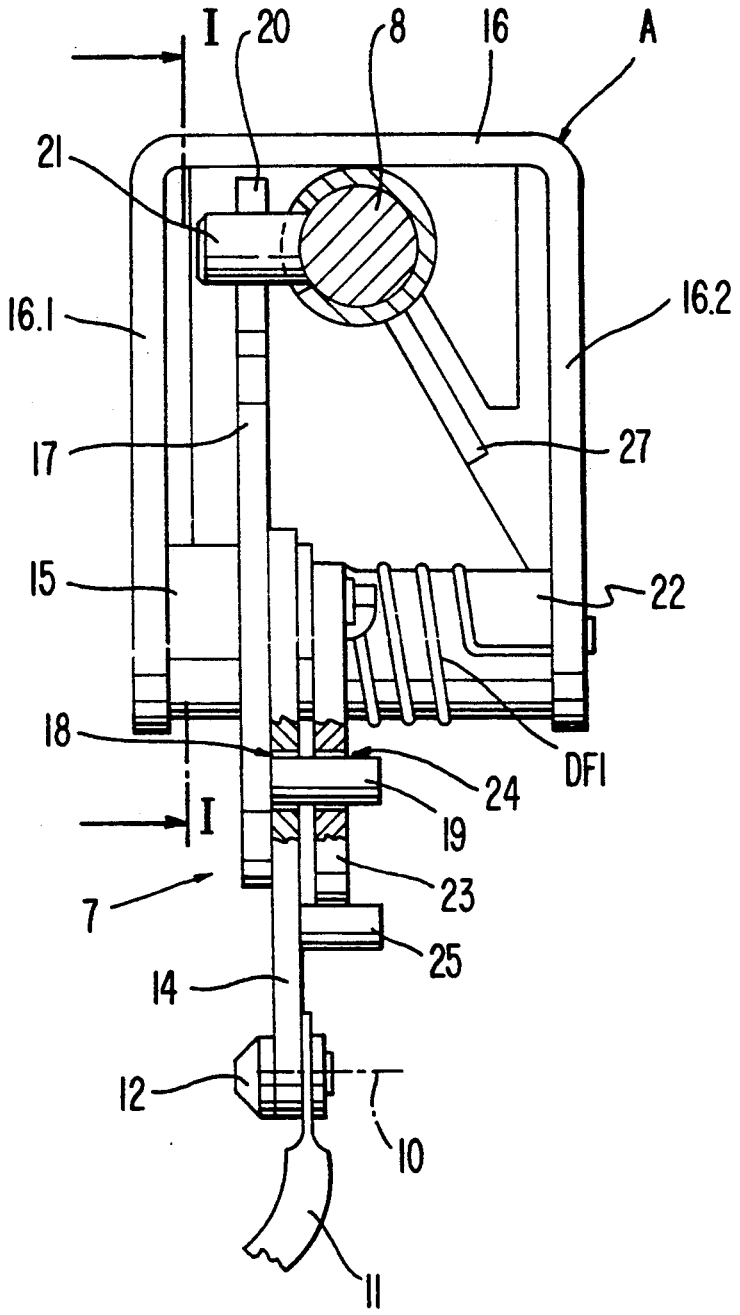
FIG. 2 is a view of a linkage of the locking device rotated through 90° relative to FIG. 1.

FIG. 2 shows the linkage 7 rotated through 90° relative to FIG. 1 and more clearly illustrates the spatial arrangement of the various linkage parts. In turn, FIG. 2 shows by way of sectional line I—I the sectional path and viewing direction of FIGS. 1, 3 and 4. It now becomes clear, in particular, that the carrier plate 16 is saddle-shaped (thereby also forming a security housing). The first bearing journal 15 and the second bearing journal 22 are fastened to mutually opposite legs 16 1 and 16.2, respectively of the carrier plate 16. The arrangement of the detent pawl 23, of the first pivoting lever 14 and of the two-armed lever 17 (from right to left in the mentioned order) in three mutually parallel planes and the length of the pin 19 of the two-armed lever 17 passing both through the long hole 18 of the first pivoting lever 14 and through the perforation 24 of the detent pawl 23 is clearly shown here, as are the arrangement of the arm 20 of the two-armed lever 17 axially offset in relation to the additional bolt 8 and the arrangement of the torsion spring DF1 on the second bearing journal 22. Moreover, the free end of the detent member 27 passing in a slotted guide through the receptacle A here and from which the closing member VG is removed can further been seen.

FIG. 3 shows the locking device 1 in the release position F of the additional bolt 8, the viewing direction being identical to that of FIG. 1. For the sake of clarity, the lock cylinder 2 is also shown here in its unlocking position which, in actual fact, it assumes only temporarily (as a rule, a return spring not shown here is arranged on the lock cylinder), while the lock 5, etc. has been omitted. The common articulation point 10 has been pivoted to the left via the free-play connection SV as a result of the rotation of the lock cylinder to the left, starting from the vertical neutral key withdrawal position AB shown in dash lines. The same effect can also be achieved, however, without a key actuation of the lock cylinder 2 by the adjusting member 12 of the further adjusting element 13, if the central-locking system ZV is activated in the unlocking direction. The only condition for this is that the lock cylinder 2 be in its neutral key withdrawal position AB.

The pin 19 of the two-armed lever 17 has simultaneously been taken up on FIG. 3 by the right-hand limitation of the long hole 18 of the first pivoting lever 14 out of the longer leg of the perforation 24 into the region of its shorter leg over and behind a step 29. It has, therefore, been possible for the force of the torsion spring DF1 to pivot the detent pawl 23 in the clockwise direction, so that now the shorter angled leg of its perforation 24 receives the pin 19. In this engaged position of the detent pawl 23, the force of the torsion spring DF 1 is now being supported on the pin 19, and in turn supports the force of the spring 9 of the bolt 8 on the step 29 (force flux: spring 9 [supported on the carrier plate 16] - bolt 8 - release pin 21 - arm 20 of the two-armed lever 17 - first bearing journal 15 - pin 19 - step 29 and second bearing journal 22). By virtue of the free-play connection SV, the lock cylinder 2 can consequently be rotated out of the illustrated unlocking position back into its neutral key withdrawal position AB again or can remain in the unlocking position, without varying the illustrated position of the bolt 8. With the detent pawl 23 engaged, the first pivoting lever 14, as is the case with the adjusting member 12 and the rod 11, is free of force and by way of the adjusting element 13 or the lock cylinder 2 can be pivoted relative to the two armed lever 17 in the securing direction over a short distance allowed by the long hole 18. The closing member VG is no longer located in the receptacle A; the flap KL is thus opened. The detent member 27 is pivoted into the receptacle A in a known way by its torsion spring DF2, thereby assisting the opening movement of the flap KL, and now bears against an offset 8A on the end face of the bolt 8.

The return into the securing position according to FIG. 1, starting from the position in FIG. 3, will now be described briefly below. For this purpose, the lock cylinder 2 has to be pivoted out of the neutral key withdrawal position AB in the looking direction again, in order to introduce a force to the right into the common point of articulation 10 on the first pivoting lever I4. However, the same effect can also be achieved without a key actuation of the lock cylinder 2 via the adjusting member 12 of the further adjusting element 13, if the central-locking system ZV is activated in the locking or securing direction.

Before the left-hand limitation of the long hole 18 in the first pivoting lever 14 runs up against the pin 19, the lift-out pin 25 of the first pivoting lever 14 is already running up against the oblique contour 26 of the detent pawl 23 and lifts this and therefore the step 29 over and beyond the pin 19 in the counter-clockwise direction counter to the force of the torsion spring DF1. The pin 19 passes again into the region of the longer leg of the perforation 24 of the detent pawl 23. The support of the force of the spring 9 introduced into the bolt 8 is, however, thereby canceled, so that the latter can pivot in the counter-clockwise direction the two-armed lever 17 via the release pin 21 of the bolt 8 and the first pivoting lever 14 via the pin 19 and the right-hand limitation of the long hole 18, with the pin 19 sliding in the longer leg of the perforation 24.

In the event that the closing member VG is not located in the receptacle A at this time, the position shown in FIG. 4 is now taken, and in this position the detent member 27 prevents the bolt 8, via the offset 8A on its end face, from passing into its securing position of FIG. 1. Only when the closing member VG is pressed into the receptacle A downwards in the direction of the arrow does it run up against the detent member 27 on its end face and pivot this member counter to the force of the torsion spring DF2 in the clockwise direction out of engagement with the offset on the end face of the bolt 8. As a result, the bolt 8 can pass through the closing member VG and assumes its securing position S. If, however, during the above-described transition into the securing position, the flap KL is already closed (for example if it has not been opened at all after a central unlocking), the detent member 27 is not effective to prevent the bolt 8 from passing unimpeded into its securing position S again.

To prevent an excessive mount of noise from being generated during the above-described operations, it is useful to provide impact or displacement damping for the bolt 8. This can be effected( for example, by an elastic buffer 33 schematically in dopped lines in FIG. 1 fastened to a limit stopper of the bolt 8, by a specific friction of the bolt 8 in its axial guide or by fluid damping of the bolt movement with a conventional fluid damping arrangement 34 schematically shown partially cutaway in FIG. 1. Furthermore, FIG. 4 also indicates a releasable interlock 30, known per se as shown in DE 3,150,564 C2 incorporated by reference herein, between the adjusting member 12 and an actuating drive 31 of the further adjusting element 13. This allows the pneumatic actuating drive 31 to move even when the adjusting member 12 is blocked via the rod 11 by the lock cylinder located in the mechanically secured position. The interlock is shown here in the disengaged position, with its normal position being restored when either the actuating drive 31 is activated in the opposite direction or the lock cylinder is moved into its unlocking position and the additional bolt 8 is therefore once again brought into its release position F.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A locking device for a boot flap or door of a motor vehicle, comprising a lock cylinder for mechanical unlocking and locking of a lock with a key; an additional bolt operatively arranged to act along with the lock on a closing member of the flap or door, which closing member is separate from the lock and which, during the locking of the lock, can be brought into a securing position in which, by positive engagement into the closing member, the additional bolt prevents the flap or door from being opened, even after the lock has been broken open, and, during the unlocking of the lock, is brought into a release position in which the flap or door can be opened; and a spring-loaded detent member which is arranged complementary with the closing member and which prevents the additional bolt from being brought into its securing position, with the flap or door opened, until the closing member is brought into its end position corresponding to the closed position of the flap or door, wherein the additional bolt is prestressed by a spring in the direction of the securing position and is movable mechanically into its release position counter to the force of the spring by a linkage lever operatively connected to the lock cylinder via a free-play connection configured to provide lost motion between the linkage lever and the lock cylinder, which linkage lever maintains the additional bolt in the release position with the lock being unlocked such that the key can be rotated between an unlocking position and a neutral key withdrawal position without change in the release position of the additional bolt.

2. The locking device according to claim 1, wherein the neutral key withdrawal position of the lock cylinder, is a position in which the lock and the linkage are isolated from the lock cylinder via the free play connection; further including an adjusting element of a vehicle central-locking system with multi-point operation for unlocking and locking the lock from a central point; and a further adjusting element of the central-locking system operatively associated with the additional bolt for movement of the additional bolt from and to the securing position into the release position, independently of a key actuation of the lock cylinder in its neutral key withdrawal position, when the central-locking system is activated in the corresponding direction.

3. The locking device according to claim 2, wherein the lock cylinder is operatively arranged to be brought, via the key, into a mechanically secured position different from the neutral key withdrawal position but allowing withdrawal of the key, in which tumblers of the lock cylinder block the lock, with the key withdrawn, against unlocking without the key and block the additional bolt in its securing position, and the further adjusting element blocks the free-play connection between the linkage lever and the lock cylinder against movement.

4. The locking device according to claim 3, wherein a detent pawl is provided in the linkage and can be moved by one of the lock cylinder and the further adjusting element during actuation in a locking or securing direction, which detent pawl keeps the additional bolt in its release position at least indirectly counter to the force of the spring prestressing it.

5. The locking device according to claim 4, wherein a first pivoting lever of the linkage, which has a common articulation point for an adjusting member of the further adjusting element and a rod of the free-play connection is mounted pivotably on a carrier plate, a two-armed lever is likewise mounted on the carrier plate pivotably about the same axis as the pivoting lever and, on one hand, is coupled thereto via a free-play drive connection and, on the other hand, acts by way of an arm on the additional bolt; and, a pivot mounting, of the detent pawl on the carrier plate is offset axially in relation to the first pivoting lever and the two-armed lever, in a plane parallel to the first pivoting lever and to the two-armed lever, with the detent pawl having an abutment for catching the two-armed lever relative to the carrier plate in a position corresponding to the release position of the additional bolt.

6. The locking device according to claim 5, wherein an angled perforation is arranged in the detent pawl, the abutment is configured as a step at the angling of the perforation, a pin is connected rigidly to the two-armed lever and passes through the perforation which has over the entire length thereof a clear width corresponding at least to the diameter of the pin; and a spring is operatively arranged to prestress the detent pawl and the step in the direction of the pin.

7. The locking device according to claim 6, wherein a long hole is provided in the first pivoting lever, and is aligned at least in regions with the perforation of the detent pawl through which hole the pin of the two-armed lever likewise passes to form the said drive connection, and which has over the entire length thereof a clear width corresponding at least to the diameter of the pin.

8. The locking device according to claim 5, wherein a lifting-out device is operatively arranged on the linkage to be movable both by the lock cylinder and by the further adjusting element and operatively is associated with the detent pawl which is spring loaded.

9. The locking device according to claim 8, wherein the lifting-out device with a lift-out pin is fastened rigidly to the first pivoting lever and offset relative to a long hole provided in the first pivoting lever so as to be movable into sliding contact with a mating contour of the detent pawl, by one of the first pivoting lever being pivoted in a locking or securing direction by the lock cylinder and the further adjusting element in relation to the two-armed lever operatively coupled thereto and fixed by the detent pawl.

10. The locking device according to claim 3, wherein a disengageable connection is operatively provided between an adjusting member connected to the linkage and an actuating drive of the further adjusting element which connection is disengaged when the actuating drive is activated in an unlocking direction and the lock cylinder is in a mechanically secured position, and is engaged again when the additional bolt is brought once more into its release position.

11. The locking device according to claim 1, wherein an impact damping means is provided on a limit stop of the additional bolt.

12. The locking device according to claim 1, wherein a damper is operatively arranged to act at least counter to the force of the spring of the additional bolt and intended for reducing the speed of the bolt when it assumes the securing position.

13. The locking device according to claim 1, wherein the additional bolt is guided in an axial direction on both sides of the closing member through which the additional bolt is configured to pass.

14. The locking device according to claim 1, wherein a security housing is provided to protect the linkage and the additional bolt against access by force.

* * * * *